US008997389B2

(12) United States Patent
Folk

(10) Patent No.: US 8,997,389 B2
(45) Date of Patent: Apr. 7, 2015

(54) PICTURE FRAME AND HANGER COMBINATION FEATURING A RECESSED CORD REEL

(71) Applicant: Deborah L. Folk, Regina Beach, CA (US)

(72) Inventor: Deborah L. Folk, Regina Beach, CA (US)

( * ) Notice: Subject to any disclaimer, the term of this patent is extended or adjusted under 35 U.S.C. 154(b) by 50 days.

(21) Appl. No.: 13/943,063

(22) Filed: Jul. 16, 2013

(65) Prior Publication Data

US 2014/0158853 A1 Jun. 12, 2014

Related U.S. Application Data

(60) Provisional application No. 61/672,061, filed on Jul. 16, 2012.

(51) Int. Cl.
*A47G 1/16* (2006.01)
*A47G 1/18* (2006.01)

(52) U.S. Cl.
CPC ..... *A47G 1/18* (2013.01)

(58) Field of Classification Search
CPC ..... A47G 1/1666
USPC ..... 40/745, 748, 753; 242/379.2
See application file for complete search history.

(56) References Cited

U.S. PATENT DOCUMENTS

| | | | | |
|---|---|---|---|---|
| 696,510 | A | 4/1902 | Still | |
| 862,011 | A * | 7/1907 | Patrick et al. | 242/379.2 |
| 885,172 | A * | 4/1908 | Patrick | 242/377 |
| 5,695,147 | A * | 12/1997 | Zimmerman | 242/388.3 |
| 6,832,446 | B1 * | 12/2004 | Lemire | 40/761 |
| 7,607,631 | B2 * | 10/2009 | Newman | 248/493 |
| 8,342,470 | B2 * | 1/2013 | Shortell | 248/329 |
| 2007/0235620 | A1 * | 10/2007 | Lampert | 248/498 |
| 2009/0283657 | A1 * | 11/2009 | Silvers et al. | 248/550 |
| 2011/0186707 | A1 * | 8/2011 | Argyle | 248/475.1 |
| 2012/0159824 | A1 * | 6/2012 | Badwey | 40/718 |

* cited by examiner

*Primary Examiner* — Gary Hoge
(74) *Attorney, Agent, or Firm* — Kyle R. Satterthwaite; Ryan W. Dupuis; Ade & Company Inc.

(57) ABSTRACT

A picture frame and hanger combination features a reel for winding and unwinding of the cord, a locking mechanism to lock the cord in any of a number of partially unwound states of different length, and a frame bordering a picture opening for receiving a picture in a position facing outward from the picture opening to a front side of the frame. The frame has a hollow cavity positioned and sized to accommodate the reel and locking mechanism, which may be combined into a single unit, in positions at least partially recessed in the frame and concealed from the front side thereof. The recessing of the reel into the frame avoids bulky installation on the rear of the frame that may otherwise prevent the frame from lying closely against the wall or other upright surface behind the picture frame.

19 Claims, 9 Drawing Sheets

PICTURE FRAME AND HANGER COMBINATION FEATURING A RECESSED CORD REEL

CROSS REFERENCE TO RELATED APPLICATIONS

This application claims benefit under 35 U.S.C. 119(e) of Provisional Application Ser. No. 61/672,061 filed Jul. 16, 2012.

FIELD OF THE INVENTION

The present invention relates generally to hanging of picture frames, and more particularly to a picture frame having an automatically retracting cord reel and cooperating cord locking mechanism to allow adjustment of a cord length for hanging of the frame at different heights without vertically relocating a support from which the picture is hung.

BACKGROUND OF THE INVENTION

It is known in the art to use a self-retracting cord reel mounted to the rear of a picture frame to span a cord across the rear of the picture frame for hanging thereof from a suitable hook, where the amount of cord deployed from the reel can be changed in order to change the height at which the frame is suspended from the hook, thus allowing easy adjustment of the picture height without vertical relocation of the hook.

Examples of such arrangements are shown in U.S. Pat. Nos. 6,965,10 and 8,620,11. However, in each of these prior art picture frame and hanger combinations, the reel forms a bulky installation on the rear of the frame, preventing the frame from lying closely against the wall or other upright surface behind the picture frame.

Accordingly, there remains room for improvement in picture frame and cord-reel picture hanger combinations.

SUMMARY OF THE INVENTION

According to a first aspect of the invention there is provided a picture frame and hanger combination comprising:

a reel having a cord secured thereto and being rotatable in opposing directions acting to wind and unwind said cord around said reel;

a locking mechanism operable to lock the cord in any of a number of partially unwound states each corresponding to a different length of said cord being deployed from around said reel; and a frame bordering a picture opening in which a picture is mountable in a position facing outward from the picture opening to a front side of the frame, the frame having a hollow cavity positioned and sized to accommodate the reel in a position that is concealed from the front side of the frame behind a front face thereof and is located at least partially between said front face of the frame and an opposing rear face thereof.

Preferably the reel is biased to rotate in the direction acting to wind said cord around said reel, and the locking mechanism is biased into a locking state. In order words, preferably the reel is an automatically retracting reel configured to bias the cord toward a fully wound condition on the reel, and the locking mechanism is an automatically locking mechanism configured to bias the cord into a locked condition fixing the length of cord deployed from the reel.

Preferably the reel is located entirely between said front and rear faces of the frame.

Preferably the hollow cavity is a recessed cavity recessed into the frame from an exterior thereof.

Preferably the hollow cavity is a recessed cavity recessed into the frame from the rear face thereof.

There may be provided a cover mounted over the recessed cavity. When such a cover is included, preferably the recessed cavity comprises a stepped border creating a ledge for seating of the cover in a position flush with or recessed from the rear face of the frame. A cord passage opening, for passage of the cord from the hollow cavity through said cord passage opening, may be provided on the frame, for example in the cover.

Preferably a hollow space in the frame is positioned and sized to receive at least a portion of the locking mechanism between the front and rear faces thereof.

Preferably the hollow space for receiving the locking mechanism is part of the hollow cavity for accommodating the reel. In other words, preferably the hollow cavity is sized to accommodate both the reel and the locking mechanism at least partially between the front and rear faces of the frame.

The frame may have a lock actuator opening arranged for access to an actuator of the locking mechanism from outside the hollow space. This lock actuator opening may be provided in the cavity cover in embodiments including such a cover.

Preferably the actuator of the locking mechanism is a release actuator operable to release an automatic locking action of the locking mechanism on the cord.

Preferably the release actuator is a push button release actuator.

Preferably there are provided multiple cord attachment points on the frame at different sides of the picture opening bordered thereby for selective connection of a free end of the cord to any of said attachment points.

Preferably there is provided a stop member attached to the cord at a free end thereof, the stop member being impassable through the cord passage opening.

Preferably the reel mechanism is located on a first side of the picture opening having a first one of the attachment points, and a cord guide is provided on the frame on a second side of the picture opening for routing the cord from the reel to said a second one of the attachment, which is also located on the second side of the picture opening.

Preferably there is provided a connector attached to the free end of the cord for engagement of the connector to any of said attachment points.

Preferably the connector is a clip.

Preferably the connector is passable through an opening of the cord guide.

In one embodiment, the reel and the locking mechanism are mounted within a common housing installed within the hollow cavity of the frame.

According to a second aspect of the invention there is provided a method of producing a picture frame and hanger combination comprising:

providing a hollow cavity between opposing front and rear faces of a frame that borders a picture opening in which a picture is mountable in a position facing outward from the picture opening to a front side of the frame; and mounting a reel at least partially within the hollow cavity of the frame, the reel having a cord secured thereto, being rotatable in opposing directions acting to wind and unwind said cord around said reel, and being provided in combination with a locking mechanism operable to lock the cord in any of a number of partially unwound states each corresponding to a different length of said cord being deployed from around said reel.

According to a third aspect of the invention there is provided a picture hanging device comprising:

a housing comprising first and second shell pieces engaged together to enclose an interior space;

a self-retracting reel rotatably mounted within the interior space of the housing; and a locking mechanism mounted within the interior space of the housing and operable to provide an automatic locking action to lock the cord in any of a number of partially unwound states each corresponding to a different length of said cord being deployed from around said reel, the locking mechanism comprising a push button actuator extending through an opening of housing for actuation of said actuator from outside the housing to release the automatic locking action on the cord.

BRIEF DESCRIPTION OF THE DRAWINGS

In the accompanying drawings, which illustrate exemplary embodiments of the present invention.

DETAILED DESCRIPTION

Figure 1:
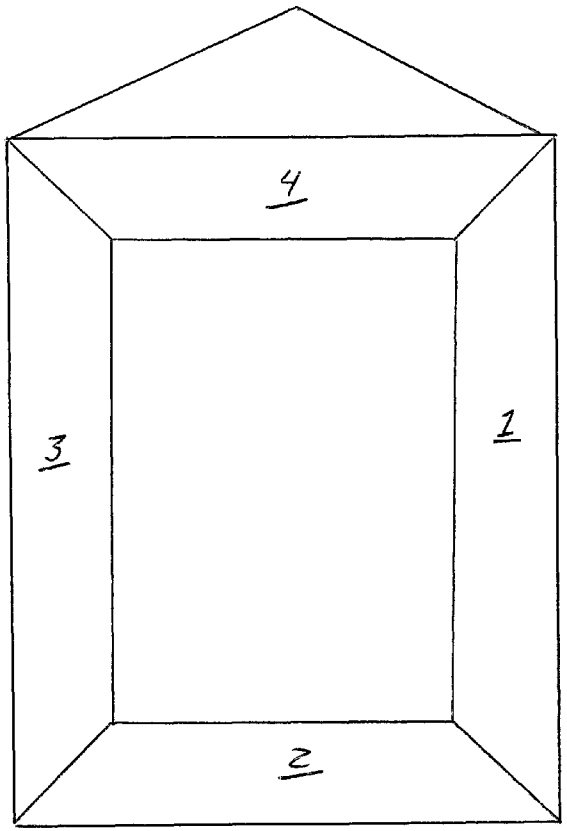
FIG. 1 is a front elevational view of a picture frame and hanger combination of the present invention.

The drawings show a picture frame and hanger combination of the present invention, which as seen in FIG. 1, has a conventional appearance when viewed from the front (i.e. from the side of the frame at which the picture is visible). In a conventional manner, the illustrated rectangular frame is made up of four elongated pieces 1, 2, 3, 4 of equal width, each with 45-degree mitre cut ends so that the four pieces are fastened together end-to-end in a rectangular configuration with the adjacent pieces running lengthwise at ninety degrees to one another. The frame pieces thus form a border closing around a rectangular space or opening bound on each side by a respective one of the pieces. The shorter lengthwise edge of each frame piece features a rabbet cut at the rear face of the frame so that the resulting rectangular cut away at this edge can accommodate placement of a rectangular sheet of glass, a photograph and a suitable rectangular backing sheet against the resulting ledge at this rear-inside lengthwise edge, whereby the photograph faces forwardly outward from the frame through the glass in a protected, stationary position sandwiched between the glass and the backing sheet.

Figure 3:
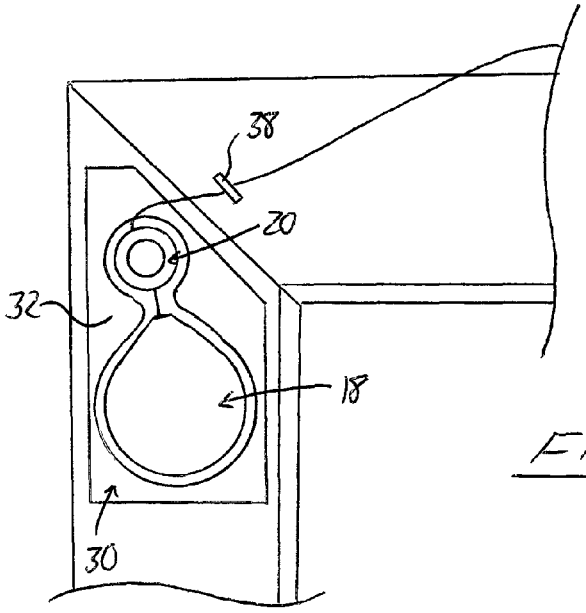
FIG. 3 is a partial rear elevational view of the picture frame and hanger combination with a cover removed from a rear-access cavity in which a cord reel and cord lock are mounted.
Figure 4:
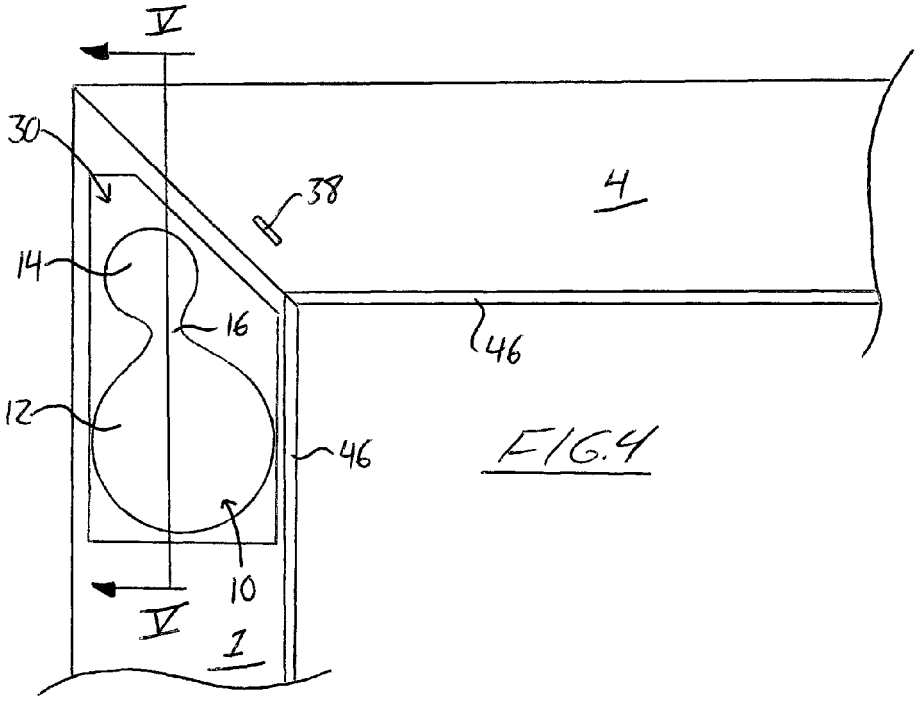
FIG. 4 is a partial rear elevational view of the picture frame with the cord reel and cord lock removed.

With reference to FIG. 4, while the forgoing frame features are conventional, the frame differs from the prior art in the presence of a cavity 10 recessed into one of the upright frame pieces 1 near the upper end thereof. In the illustrated embodiment, this hollow cavity features a first lower circular portion 12, a smaller second circular portion 14 disposed above the first, and a narrow neck portion 16 joining the two circular portions together. Turning to FIG. 3, the larger circular portion 12 of the recessed cavity 10 receives a self-retracting cord reel 18, which may be of a known conventional type with a drum rotatably supported in a housing, a cord with one end fixed to the drum and passing through an opening in the housing to a free second end outside the housing, and a spiral spring biasing the drum in a rotational direction acting to wind the cord fully onto the drum. A known type of automatically retracting reel that may be employed in the present invention are those commonly employed retractable reels for carrying badges, identification cards or keys on one's person, for example clipped to one's belt or clothing.

The smaller circular portion 14 of the hollow cavity 10 features a cord lock mechanism 20 through which the cord passes from the drum to the free end of the cord. The cord lock may also be of a known conventional type, with a push button plunger 22 slidable back and forth in an axial direction in a blind hole of main housing 24. The plunger and the housing have parallel through-bores 22*a*, 24*a* extending in a direction perpendicular to the sliding direction of the plunger. A compression spring 26 is disposed between the closed end of the housing's blind hole and the inner end of the plunger inside the blind hole. In its normal extended state, the compression spring 26 forces the plunger away from the closed end of the blind hole, attempting to force the transverse bore of the plunger fully past the transverse bore of the housing. When the spring 26 is depressed by manual pressing of the plunger, it acts to move the transverse bores into an at least partially aligned condition where the bores are open to one another. The cord from the reel passes through the lock mechanism via the two transverse bores.

As schematically shown in FIG. 3, the cord 28 extends from its wound portion on the reel 18 in the larger circular portion of the cavity 10, through the neck 16 of the cavity into the smaller circular portion 14 thereof, where the cord 28 passes through the cord lock 20 to a free end of the cord situation outside the hollow cavity. The spring's action on the plunger of the cord lock acts to clamp the cord in place, as the end of the plunger's bore nearest the inner end of the plunger is forced toward the end of the housing's bore furthest from the closed end of the blind hole in the housing. The cord is thus locked in place between the opposing ends of the two transverse bores by the action of the compression spring. The cord is only released from this clamped condition between the plunger and housing by manually depressing the plunger toward the closed end of the housing's blind hole against the action of the spring. Accordingly, the cord is locked in its given state partially wound on the reel at any given time, but the plunger forms a push button release by which the locking action on the cord is released, allowing adjustment of the length of cord deployed from the reel. Depressing the plunger and pulling the free end of the cord acts to deploy more of the cord from the reel, while depression of the plunger alone will allow the drum of the reel to rotate in its default retracting direction, spooling more of the cord onto the reel.

Figure 2:
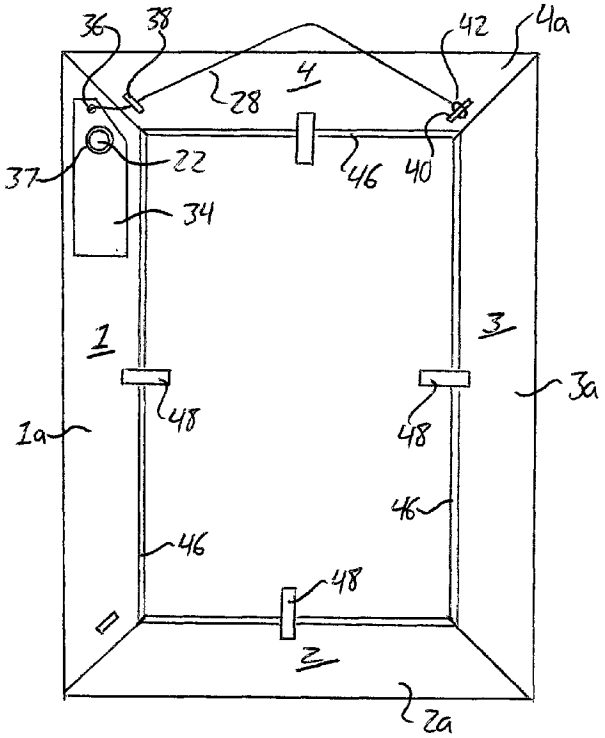
FIG. 2 is a rear elevational view of the picture frame and hanger combination.
Figure 5:
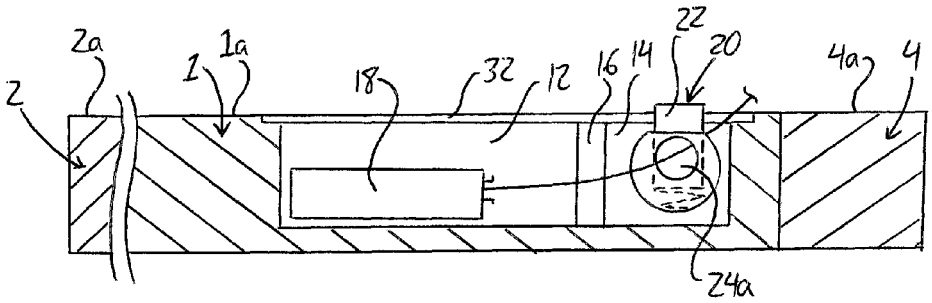
FIG. 5 is a partial cross-sectional view of the picture frame, as would be viewed along line V-V thereof of FIG. 4, with the cover removed by the cord reel and cord lock installed.
Figure 6:
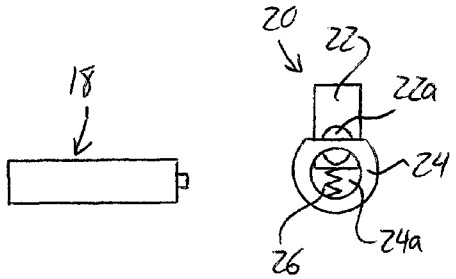
FIG. 6 is an isolated view of the cord reel and cord lock used on the picture frame.

With reference to FIG. 5, the rear faces 1*a*, 2*a*, 3*a*, 4*a* of the frame pieces 1, 2, 3, 4 of the illustrated embodiment are flat and coplanar with one another, except at an area 30 within which the hollow cavity 10 recesses into the first frame piece 1. This area 30 is larger in plan, but smaller in depth, than the hollow cavity 10 itself, thus creating a shallower recess 32 that surrounds the hollow cavity 10 and forms a stepped border transitioning from the hollow cavity to the rear face of the frame. In the illustrated embodiment, the area 30 has five straight sides cooperating to form a rectangular portion containing the larger circular portion 12 and neck 16 of the cavity 10, and a truncated-triangular portion that is disposed atop the rectangular portion, contains the smaller circular portion 14 of the cavity and lies in alignment with the taper of the mitred end portion of the frame piece 1. Turning to FIG. 2, the recessed area 30 accepts a conformingly shaped cover 34 that sits on the ledge formed by the stepped boundary of the cavity in order to close over the hollow cavity 10 when the reel 18 and cord lock 20 have been installed therein. The thickness of the cover 34 closely matches the depth of the recess 32 so that the outer face of the cover lies generally flush with the rear face of the picture frame when installed. The cover may use any suitable fastening means to remain in place over the hollow cavity, for example employing a snap fit with the frame piece or using a threaded fastener engaged into the frame piece through a suitable opening in the cover 34.

The cover features a cord-accommodating hole 36 therein near the narrower upper end of the cover to allow the cord to pass through the cover from the cord lock 20 inside the hollow cavity to the exterior of the picture frame. A larger lock actuator hole 37 situated a short distance below the cord-accommodating hole 36 provides an opening through which one's finger can depress the plunger 22 of the cord lock 20, or through which the plunger 22 extends to provide access thereto outside the picture frame at the rear side thereof. A first eyehook 38 is fastened to the rear face 4*a* of the upper cross-wise frame piece 4 that projects horizontally from the upper end of the upright frame piece 1 near the hollow cavity formed therein. This first eyehook 38 forms a guide near the end of the cross-wise frame piece 4 lying adjacent the upright frame piece 1 with the hollow cavity. The cord 28 passes through the opening of this guiding eyehook 38, and a clip 40 fixed to the free end of the cord 28 is releasably connected to the eye of a second eyehook 42 disposed at an opposite end of the same cross-wise frame piece 4. The two eyehooks are situated at matching positions across the width of the cross-wise frame piece 4 to lie at the same height when the length of this piece 4 is oriented horizontally. The span of the cord between the two eye-hooks forms a hanger by which the picture frame can be suspended from a hook or other suitable support on a wall or other upright surface.

A third eyehook 44 is fastened to the reel-quipped upright frame piece 1 adjacent the lower end thereof opposite the hollow cavity. This eyehook 44 is situated at a position matching that of the cord-accommodating hole 36 in the cover 34 across the width dimension of the upright frame piece 1. The opening in the guiding eyehook 38 is large enough to accommodate passage of the clip 40 therethrough, whereby the free end of the cord 28 can be decoupled from the second eyehook 40, drawn back through the guiding first eyehook 38, and then extended along the first frame piece 1 to attach to the third eyehook 44. This way, the cord 28 can be reoriented to lie along the first frame piece 1 in which the hollow cavity is formed instead of the shorter adjacent frame piece 4. The cord 28 can then be used to hang the picture frame from the first frame piece 1 instead of the other frame piece 4, allowing the elongated rectangular picture frame to be hung in either a length-upright portrait orientation or a length-horizontal landscape orientation according to the picture that is to be displayed within the frame.

While the clip is small enough to fit through the guiding eyehook 38, it is too large to fit through the cord-accommodating opening 36 in the cover installed over the hollow cavity of the frame. This way, the inability of the clip to fit through the cord-accommodating opening 36 prevents the free end of the cord from being retracted into the hollow cavity when the lock-release plunger of the cord lock is depressed.

Figure 7A:
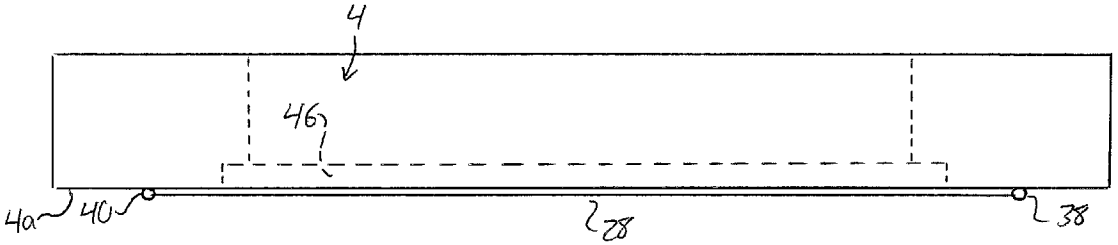
FIGS. 7A and 7B are outside and inside views of a top cross-wise frame piece of the picture frame.
Figure 7B:
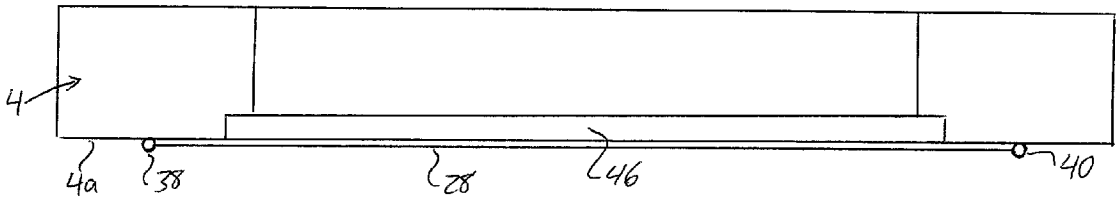
Figure 8A:
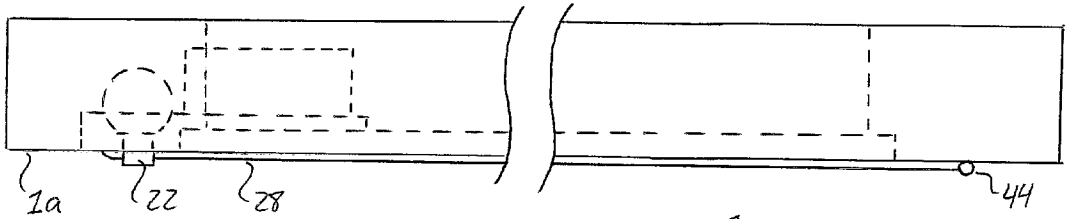
FIGS. 8A and 8B are outside and inside views of an upright frame piece having the rear access cavity in which the cord reel and cord lock are mounted.
Figure 8B:
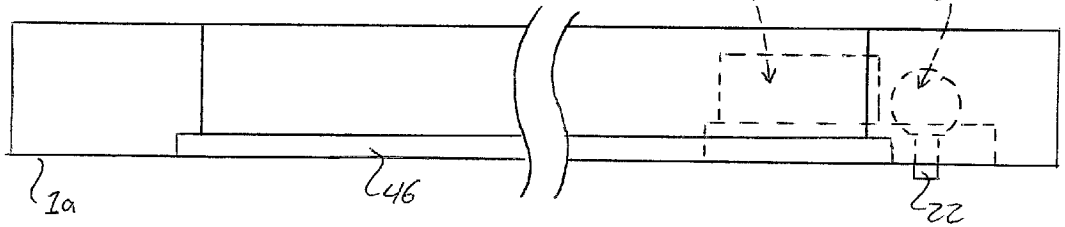

FIGS. 7 and 8 show profile views of the upper cross-wise frame piece 4 and cavity-equipped upright frame piece 1 from both the inside and outside edges thereof. The shape of the lower cross-wise frame piece 2 is a mirror image of the upper one, the piece 2 differing only in the lack of eyehooks 38, 40, and the outer shape of the second upright frame piece 3 is a mirror image of the first upright frame piece 1, the piece 3 differing in the lack of eyehook 44, hollow cavity 10, recessed area 30, cover 34, cord reel 18 and cord lock 20. Each frame piece has a rabbet cut recess 46 at the corner joining the inside edge and rear face of the frame piece. This recess 46 accommodates a rectangular piece of glass and matching rectangular piece of backing material, and a picture sandwiched therebetween, within the opening bound by the frame pieces. The depth of the recess 46 closely follows that of the sandwiched glass, picture and backing sheet/board so that this sandwiched configuration lies generally flush with the rear face of the frame pieces. With reference to FIG. 2, tabs 48 of metal or other material are coupled to the rear faces of the frame pieces to swivel along the plane of these rear faces into and out of positions overhanging the inner edges of the frame pieces to accommodate placement of the glass, picture and backing within the frame when the tabs are withdrawn from over the picture opening, and to secure the glass, picture and backing in place when the tabs are subsequently pivoted out over the rear face of the backing material. Other known tab designs that may be employed include bendable tabs fixed to the inner edge of the frame pieces to bend over the rear face of the backing material.

The tension that acts against the extension of the cord from the reel is sufficient to suspend the weight of the frame, glass, picture and backing without extending the cord, for example providing 10-lbs of tension, with the spring strength and frictional engagement of the cord at the locking mechanism being strong enough to hold the cord against the reel's cord-retracting action. To change the height at which the picture is hung, a user depresses the lock-release plunger of the cord lock, and either pulls more of the cord from the reel in order to increase the freed length of cord to obtain a lower picture height when hung, or allows the reel to automatically retract more cord in order to tension the cord to a reduced length in order to increase the picture height when hung. After the hanging-cord is adjusted to a desired length, release of the lock plunger automatically locks to the cord to this effective picture-hanging length. With the recessed condition of the cord lock entirely within the frame between the front and rear faces thereof, this adjustability is provided in a relatively thin configuration comparable to that of a conventional picture frame lacking a length adjustable hanging cord.

The picture frame may be factory equipped with the hollow cavity and corresponding reel and lock combination, or existing picture frames may be retrofitted to add a reel and lock combination by forming a suitable recessed cavity into which a separately acquired reel and lock combination can be mounted in one of the frame members. Even embodiments where the reel and lock are only partially recessed into the frame would still provide space-efficient advantage over the prior art configurations with entirely external cord retracting and locking mechanisms. Although the illustrated embodiment features a rear-access cavity for optimal concealment of the cavity when the picture frame is hung against a wall or other upright surface, other embodiments may employ other configurations, for example a cavity recessed into the frame from an outer peripheral edge thereof, with a suitable cord-accommodating hole through to the rear of the frame. Other rear-access embodiments may forgo a cavity cover if the cavity is sufficiently hidden from sight when the frame is hung and the reel and lock are secured to the frame.

Although the forgoing embodiment employs separate reel and lock mechanisms, other embodiments may combine these mechanisms into a single unit, for example having a singular unitary housing of molded plastic. Where separate mechanisms are used, they may be mounted in separate recessed cavities, provided that suitable passage for the cord from one cavity to the other is provided. The picture frame may be produced from any of a number of different materials, including but not limited to solid wood or medium density fibreboard (MDF).

FIGS. 9 to 13 illustrate an embodiment with a combined reel and lock assembly within a common housing 50. The housing is of a two-piece shell construction, with a top shell piece 52 and a bottom shell piece 53 of generally matching peripheral shape. In the illustrated embodiment, the peripheral shape resembles that of a figure-eight, whereby the shape of the housing in plan view may be considered to have to slightly overlapping circular areas defining round, lobed ends of the housing, which has a narrower, pinched center intermediate of the two ends.

Figure 11:
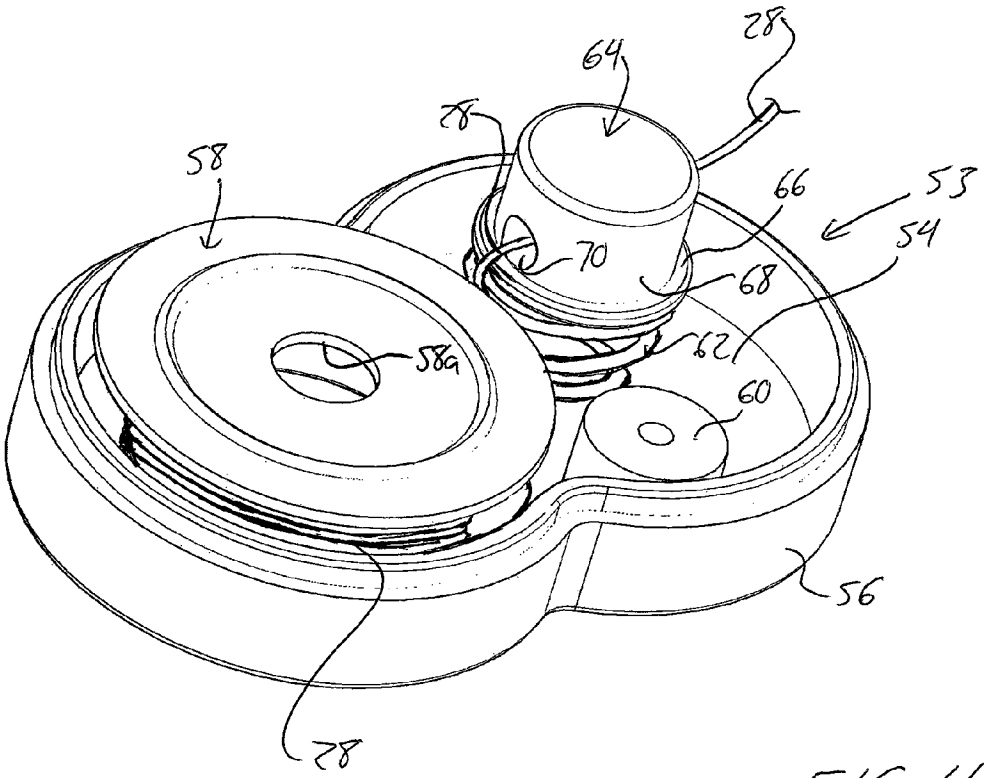
FIG. 11 is a topside perspective view of the cord reel and cord lock assembly of FIG. 9 with the top cover shell thereof removed to illustrate internal features of the assembly.
Figure 12:
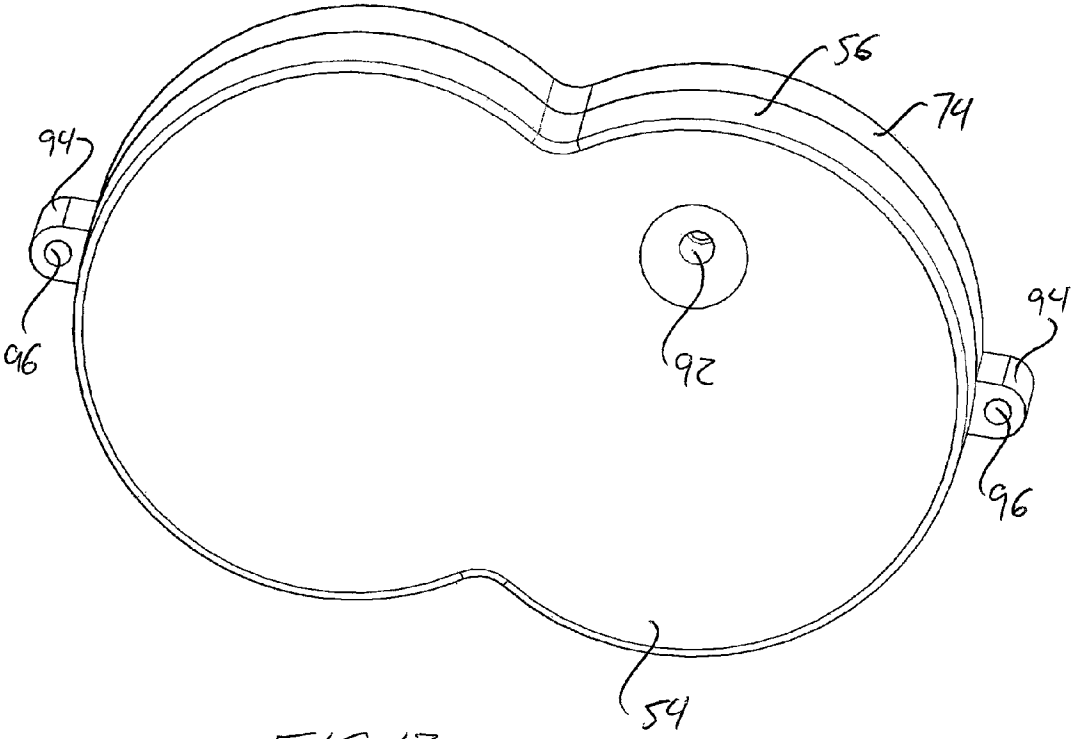
FIG. 12 is an underside perspective view of the cord reel and cord lock assembly of FIG. 9.
Figure 13:
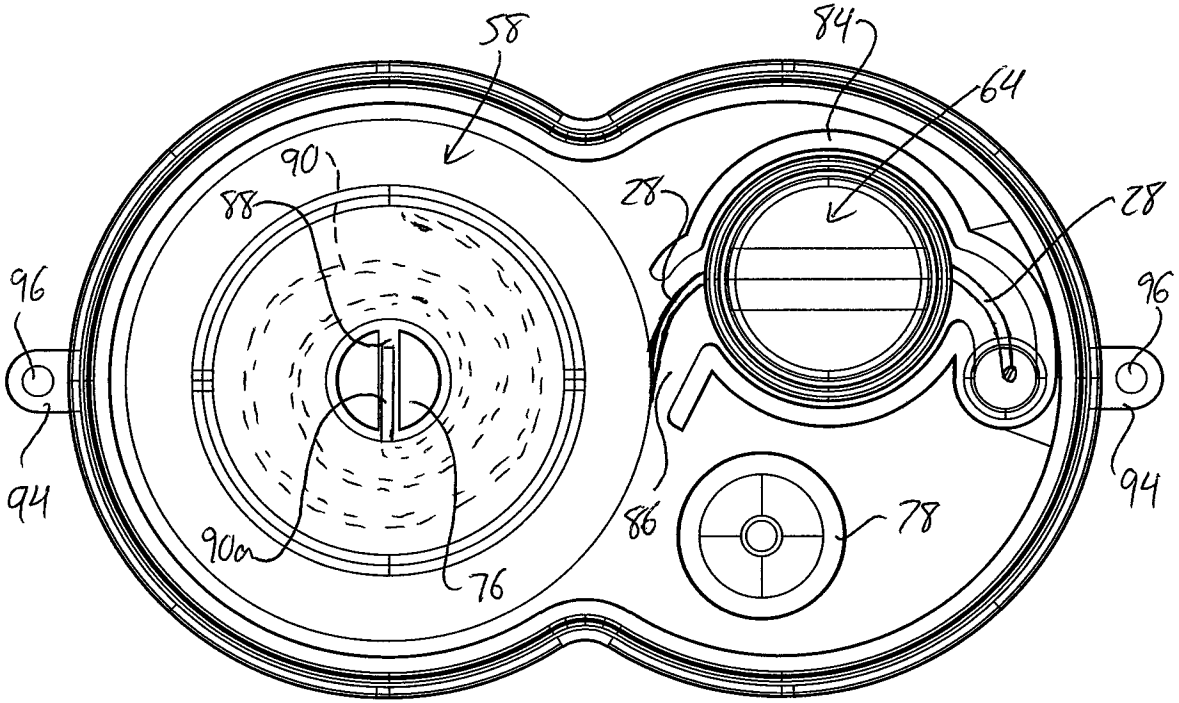
FIG. 13 is a top plan view of the cord reel and cord lock assembly of FIG. 9 with the top cover shell shown in transparency to illustrate the internal features of the assembly.

With reference to FIG. 11, the bottom shell piece has a flat bottom wall 54 and a peripheral wall 56 perpendicularly upstanding therefrom around the figure-eight outline of the bottom wall's perimeter so as to accordingly define to the overall shape of the housing. One of the two circular areas of the shell piece inside the peripheral wall thereof is occupied by a reel drum 58 on which the cord 28 is wound. The other circular area inside the peripheral wall contains an integral fastener-receiving boss 60 perpendicularly upstanding from the flat bottom of the shell piece, and a coiled compression 62 spring seated atop the bottom of the shell piece. A plunger 64 is seated atop the compression spring, and features an annular flange 66 projecting radially outward relative to a cylindrical remainder 68 of the plunger at a flat bottom end thereof seated atop the compression spring 62. A diametrical through-bore 70 passes through the cylindrical portion of the plunger 64 immediately above the flange 66. During assembly of the combined reel and lock unit by the manufacturer, the free end of the cord 28 is fed from the reel drum 58 through the diametrical through-bore 70 of the plunger 64, as shown in FIG. 11.

Figure 10:
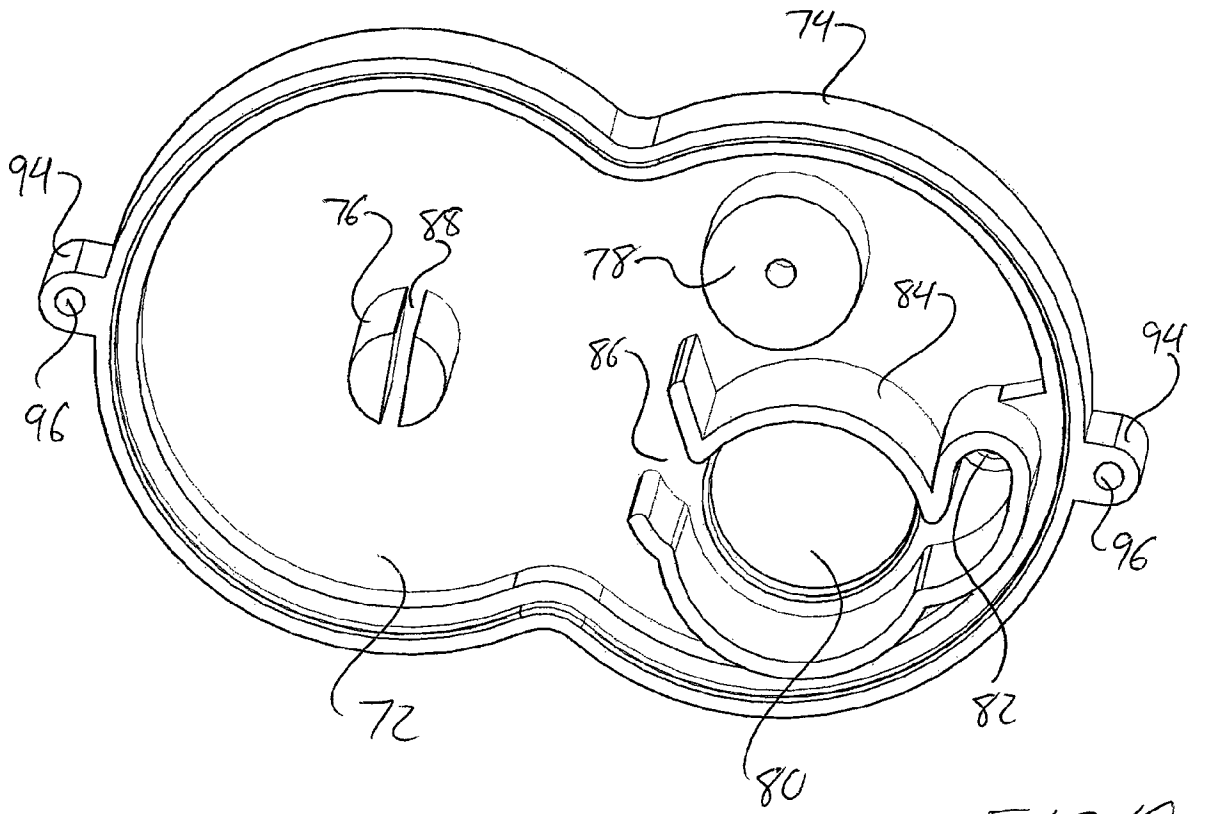
FIG. 10 is an underside perspective view of a top cover shell of a housing of the cord reel and cord lock assembly of FIG. 9.

FIG. 10 shows the matching top shell piece 52, featuring a flat top wall 72 and a peripheral wall 74 depending perpendicularly therefrom around the figure-eight perimeter of the flat top wall. The peripheral walls of the two shell pieces are stepped at the distal edges thereof with mating profiles so as to positively align the two shell pieces with one another when these distal edges of the two pieces are brought together. In the circular area of the top shell piece 52 that aligns with the reel-holding area of the bottom shell piece 53, a split cylindrical boss 76 depends perpendicularly from the flat top wall 72 at the axial center of this circular area within the peripheral wall. In the other circular area of the top shell piece, a second fastener-receiving boss 78 projects perpendicularly from the flat top wall at a position to align with the corresponding fastener-receiving boss 60 of the bottom shell piece 53.

In the same circular area as the fastener-receiving boss 78, the top wall 72 of the top shell piece 52 features a plunger-receiving opening 80 of diameter that slightly exceeds the cylindrical portion 68 of the plunger 64, but is less than the diameter of the plunger's flange 66, and also features a cord-receiving opening 82 of greater diameter than the cord 28. A retaining wall 84 depends perpendicularly from the top wall 72 around the two openings 80, 82 therein, and curves concentrically and conformingly around the plunger-receiving opening 82 at a at a radial distance therefrom that slightly exceeds the radial extent by which the plunger's flange 66 projects from the cylindrical portion of the plunger. That is, a diameter between opposing arcuate sections of the retaining wall 84 slightly exceeds the diameter of the flanged end of the plunger 64.

Figure 9:
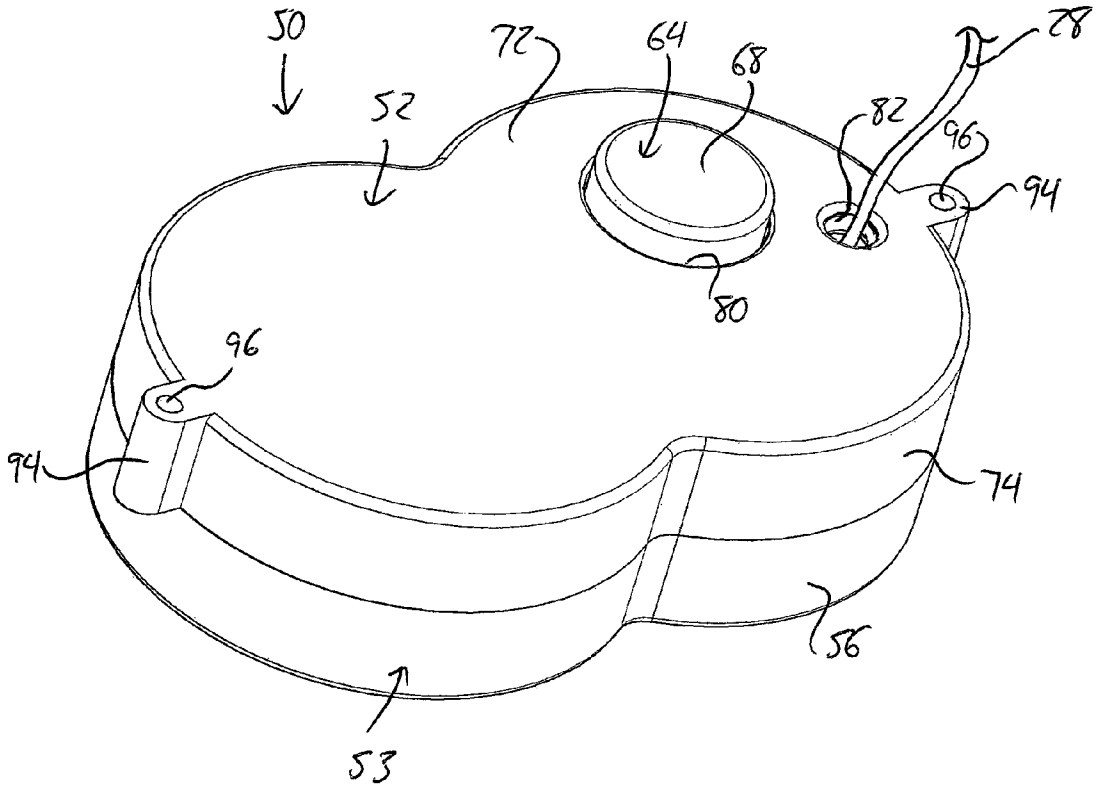
FIG. 9 is a topside perspective view of a combined cord reel and cord lock assembly usable in a picture frame and hanger combination of the present invention.

With reference to FIG. 9, when the two shell pieces of the housing are mated together, the cylindrical end of the plunger 64 projects slightly through the plunger-receiving opening 80 of the top shell piece 52 to form the push-button actuator of a cord release mechanism that is defined by the cooperation of the spring, plunger and top shell piece of the housing. The compression spring 62 biases the flanged bottom end of the plunger 64 toward the top wall of the top shell piece, which normally causes the cord 28 to be clamped in place between the flange 66 of the plunger 64 and top wall of the top shell piece at a location just outside the plunger-receiving opening therein. With reference to FIG. 10, a break or gap 86 in the retaining wall 84 at the side of the plunger-receiving nearest the split cylindrical post 76 acts to accommodate routing of the cord from the reel drum 58 to the diametrical through-bore 70 of the plunger 64. From where it is normally clamped against the top wall of the top shell piece, the cord continues through the diametrical through-bore 70 of the plunger 64, and then onward through the cord-receiving opening 82 so as to place the free end of the cord 28 outside the housing 50.

Inside the core of the reel drum 58, a spiral flat spring 90 has one end 90*a* fitted within the diametrical slot 88 that separates the two halves of the split-cylinder boss or post 76, and the other end connected to the cord 28 where the cord enters the interior space of the drum core through a suitable opening therein. In the assembled housing, the walls of the reel drum at opposite ends of its hollow cylindrical core feature central holes 58*a*, one of which accommodates insertion of the split-cylindrical post 76 into the core of the drum during assembly of the housing. The drum thus rotates about the axis of the split-cylindrical post 76 inside the respective circular area of the housing's interior space enclosed between the two shell covers 52, 53.

In a known manner, the action of the spiral flat spring cooperates with the cord and drum to define a self-winding reel, where pulling of the free end of the cord from the reel acts to tighten or wind the spiral spring as the drum rotates about its central axis in this direction that unwinds the cord from same. The built up tension in the spring, when released, thus acts to automatically pull the cord in the opposing direction, thus turning the drum in this second direction so as to rewind the cord back onto the drum. The spring biased plunger 64 normally holds the cord in place against the cord-winding tension of the spiral flat spring. However, when a user depresses the exposed cylindrical end of the plunger outside the housing against the bias of the compression spring 62, the cord is released from its clamped position against the top shell of the housing, whereupon the action of the spiral flat spring automatically winds the cord back onto the drum.

A threaded fastener is engaged through central bores of the fastener-receiving bosses of the two shell pieces of the housing, for example via a counter-bored end 92 of the through-bore in the bottom piece's boss 60 that extends through the bottom wall of the bottom piece 53. Such fastener thus secures the two shell covers 52, 53 together in the assembled state. Fastening ears 94 project from the outer periphery of the housing, for example at opposing ends of the top shell piece, and feature respective through-bores 96 through which screws may be driven into the bottom of the picture frame recesses in order to secure the assembled reel and lock unit in place in the recess of the picture frame.

The single assembled unit of FIGS. 9 to 13 thus provides the same function of the separate self-winding reel and cord lock mechanisms of the embodiment of FIGS. 1 to 8. The assembled unit of FIGS. 9 to 13 can thus be recessed into a picture frame that like of the other figures in order to provide the same functional results. As the housing of the combined reel and lock unit has both the reel and the locking mechanism mounted within it, and the housing is equipped with features for securely fastening the housing to the frame, such embodiments may optionally forgo a cover for the cavity of the picture frame. The cord-receiving opening 82 of the housing thus corresponds to, and replaces, the cord-accommodating hole of the cavity cover in the first embodiment.

It will be appreciated that the terms 'top' and 'bottom' used in describing the combined reel and lock unit of FIGS. 9 to 13 refer respectively to the sides of unit that face out of and into the recessed space in the picture frame when the unit is installed, and do not denote a particular orientation in which the unit must be installed and used. In fact, the 'top' and 'bottom' of the housing will typically not be in such relative vertical positions to one another in the typical hanging orientation of a picture frame.

End consumers or frame manufacturers or sellers may purchase a combined reel and lock unit prefabricated by another manufacturer, and then install the purchased unit in any picture frame by modifying the frame to include a suitably shaped recess to accommodate the housing of the reel and lock unit, for example using readily available professional or consumer grade tools. For example, and end consumer may trace the shape of the housing onto the rear face of the frame using either a suitable template or the housing itself, drill a blind hole into the frame, and then from the blind hole, use a hand router to hollow out the traced area for subsequent mounting of the housing into the resulting recessed cavity of the frame. A frame manufacturer or customizer may follow a similar process, or use larger scale machining equipment to similarly create the housing-accommodating cavity in the frame. It will be appreciated that the shape of the recess does not necessarily need to conform to that of the housing, and that the housing may be provided with shapes other than the figure-eight shape shown and described herein.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A picture frame and hanger combination comprising:

a reel having a cord secured thereto and being rotatable in opposing directions acting to wind and unwind said cord around said reel;

a locking mechanism operable to lock the cord in any of a number of partially unwound states each corresponding to a different length of said cord being deployed from around said reel; and a frame bordering a picture opening in which a picture is mountable in a position facing outward from the picture opening to a front side of the frame, the frame having a hollow cavity positioned and sized to accommodate the reel in a position that is concealed from the front side of the frame behind a front face thereof and is located at least partially between said front face of the frame and an opposing rear face thereof.

2. The combination of claim 1 wherein the reel is biased to rotate in the direction acting to wind said cord around said reel, and the locking mechanism is biased into a locking state.

3. The combination of claim 1 wherein the reel is located entirely between said front and rear faces of the frame.

4. The combination of claim 1 wherein the hollow cavity is a recessed cavity recessed into the frame from an exterior thereof.

5. The combination of claim 1 wherein the hollow cavity is a recessed cavity recessed into the frame from the rear face thereof.

6. The combination of claim 4 comprising a cover mounted over the recessed cavity.

7. The combination of claim 1 wherein the hollow cavity is sized to accommodate both the reel and the locking mechanism at least partially between the front and rear faces of the frame.

8. The combination of claim 1 wherein a hollow space in the frame is positioned and sized to receive at least a portion of the locking mechanism between the front and rear faces thereof.

9. The combination of claim 8 wherein the frame has a lock actuator opening arranged for access to an actuator of the locking mechanism from outside the hollow space.

10. The combination of claim 9 wherein the actuator of the locking mechanism is a release actuator operable to release an automatic locking action of the locking mechanism on the cord.

11. The combination of claim 10 wherein the release actuator is a push button release actuator.

12. The combination of claim 1 comprising multiple cord attachment points on the frame at different sides of the picture opening bordered thereby for selective connection of a free end of the cord to any of said attachment points.

13. The combination of claim 12 wherein the reel mechanism is located on a first side of the picture opening having a first one of the attachment points, and a cord guide is provided on the frame on a second side of the picture opening for routing the cord from the reel to said a second one of the attachment, which is also located on the second side of the picture opening.

14. The combination of any one of claim 12 comprising a connector attached to the free end of the cord for engagement of the connector to any of said attachment points.

15. The combination of claim 13 comprising a connector attached to the free end of the cord for engagement of the connector to any of said attachment points, the connector being passable through an opening of the cord guide.

16. The combination of claim 1 wherein the reel is an automatically retracting reel configured to bias the cord into a fully wound condition on the reel, and the locking mechanism is an automatically locking mechanism configured to bias the cord into a locked condition.

17. The combination of claim 1 wherein the reel and the locking mechanism are mounted within a common housing installed within the hollow cavity of the frame.

18. A method of producing a picture frame and hanger combination comprising:

providing a hollow cavity between opposing front and rear faces of a frame that borders a picture opening in which a picture is mountable in a position facing outward from the picture opening to a front side of the frame; and mounting a reel at least partially within the hollow cavity of the frame, the reel having a cord secured thereto, being rotatable in opposing directions acting to wind and unwind said cord around said reel, and being provided in combination with a locking mechanism operable to lock the cord in any of a number of partially unwound states each corresponding to a different length of said cord being deployed from around said reel.

19. The method of claim 18 where the step of mounting the reel comprises mounting a combined reel and lock unit within the hollow cavity, the combined reel and lock unit being a pre-assembled unit containing both the reel and the locking mechanism within a common housing of said pre-assembled unit.

* * * * *